US007415970B2

(12) United States Patent
Zdroik et al.

(10) Patent No.: US 7,415,970 B2
(45) Date of Patent: Aug. 26, 2008

(54) FUEL INJECTOR RETENTION CLIP

(75) Inventors: Michael J. Zdroik, Metamora, MI (US); Robert Doherty, Syracuse, IN (US)

(73) Assignee: Millennium Industries Corp., Auburn Hills, MI (US)

( * ) Notice: Subject to any disclaimer, the term of this patent is extended or adjusted under 35 U.S.C. 154(b) by 0 days.

(21) Appl. No.: 11/835,186

(22) Filed: Aug. 7, 2007

(65) Prior Publication Data

US 2007/0266996 A1 Nov. 22, 2007

Related U.S. Application Data

(60) Division of application No. 11/361,550, filed on Feb. 24, 2006, now Pat. No. 7,360,524, which is a continuation-in-part of application No. 11/003,059, filed on Dec. 3, 2004, now Pat. No. 7,159,570.

(51) Int. Cl.
*F02M 61/14* (2006.01)

(52) U.S. Cl. ..... 123/470; 123/469; 239/600

(58) Field of Classification Search ..... 239/600; 123/468, 470, 469
See application file for complete search history.

(56) References Cited

U.S. PATENT DOCUMENTS

| | | | | | |
|---|---|---|---|---|---|
| 134,158 | A | * | 12/1872 | Nutting | 285/114 |
| 4,474,160 | A | * | 10/1984 | Gartner | 123/468 |
| 4,929,002 | A | * | 5/1990 | Sauer | 285/319 |
| 4,993,390 | A | | 2/1991 | Ono | |
| 5,167,213 | A | | 12/1992 | Bassler et al. | |
| 5,301,647 | A | * | 4/1994 | Lorraine | 123/470 |
| 5,520,151 | A | * | 5/1996 | Gras et al. | 123/470 |
| 5,803,052 | A | | 9/1998 | Lorraine et al. | |
| 6,019,089 | A | * | 2/2000 | Taylor et al. | 123/470 |
| 6,382,187 | B1 | | 5/2002 | Scollard et al. | |
| 6,457,456 | B1 | * | 10/2002 | Scollard et al. | 123/470 |
| 6,481,420 | B1 | * | 11/2002 | Panasuk et al. | 123/470 |
| 6,539,920 | B1 | * | 4/2003 | Spiers | 123/456 |
| 6,601,564 | B2 | | 8/2003 | Davey | |
| 6,668,803 | B1 | | 12/2003 | McClean et al. | |
| 6,705,292 | B2 | | 3/2004 | Bugos | |
| 6,830,037 | B1 | | 12/2004 | Braun et al. | |
| 6,874,477 | B1 | * | 4/2005 | Lorraine et al. | 123/468 |
| 6,874,478 | B2 | | 4/2005 | Minoura et al. | |
| 7,159,570 | B2 | * | 1/2007 | Zdroik | 123/470 |

* cited by examiner

*Primary Examiner*—Stephen K. Cronin
*Assistant Examiner*—J. Page Hufty
(74) *Attorney, Agent, or Firm*—Dykema Gossett PLLC

(57) ABSTRACT

A fuel delivery system in accordance with the present invention comprises a fuel rail having an outlet opening and an outlet cup that is insertable into the outlet opening. The cup includes a flange. The flange includes at least one tab extending therefrom. The cup further defines a vertical axis extending therethrough. The system further includes a fuel injector with an inlet insertable within the cup. The system still further includes a retention clip. The clip includes an inner peripheral surface, at least a portion of which is configured for engagement with the injector when the clip and injector are assembled together. The clip further includes at least one arm, the arm further including a finger configured for spring engagement with the tab of the cup. The clip is operative to limit the movement of the fuel injector when it is assembled with the clip and inserted in the cup.

13 Claims, 15 Drawing Sheets

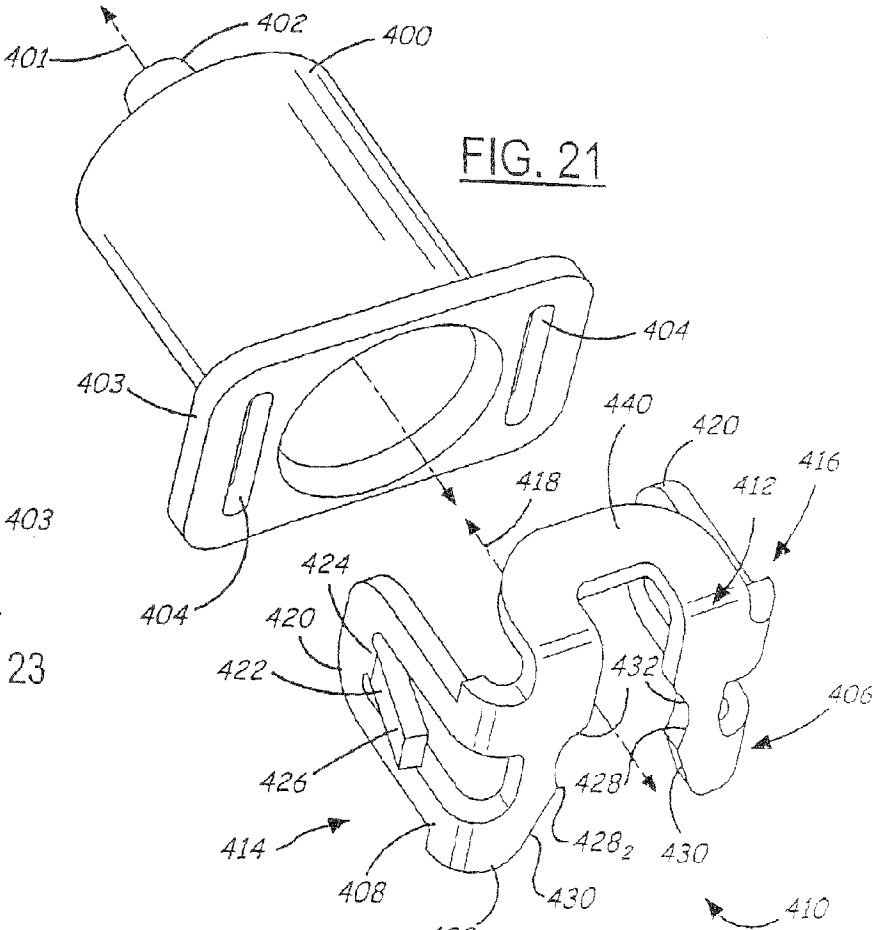
FIG. 21
FIG. 22
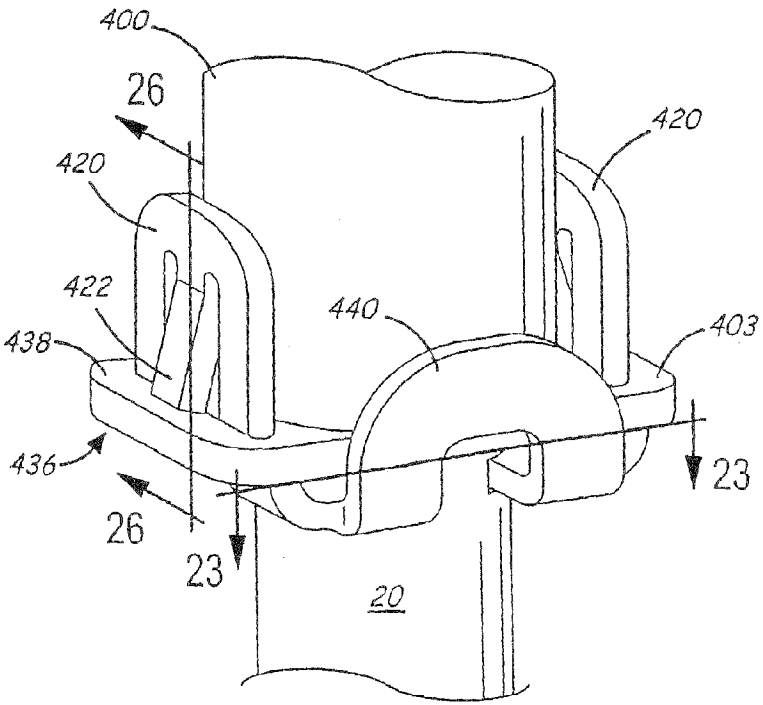
FIG. 20

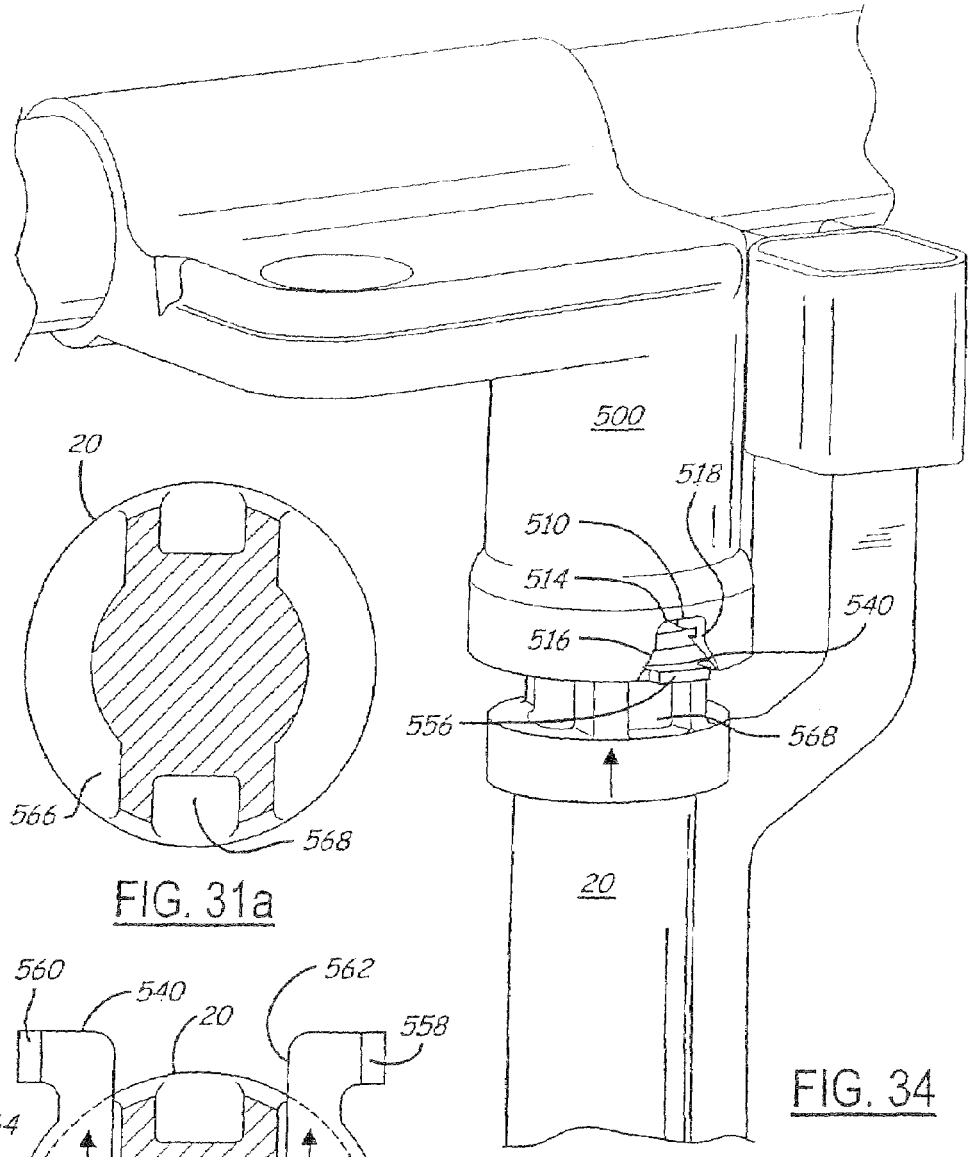
FIG. 34
FIG. 31a
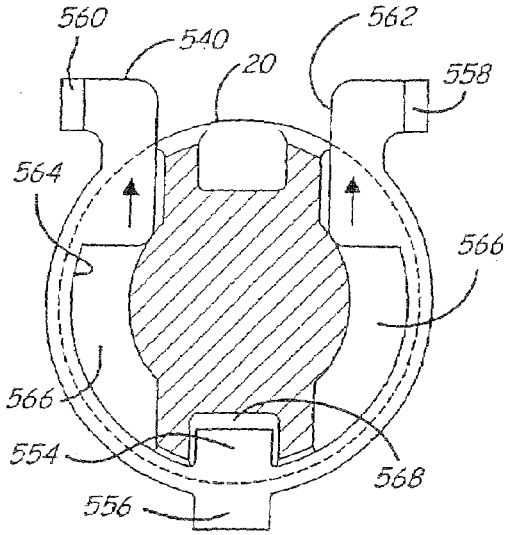
FIG. 31b

FUEL INJECTOR RETENTION CLIP

CROSS REFERENCE TO RELATED APPLICATIONS

This application is a Divisional of U.S. patent application Ser. No. 11/361,550 entitled Fuel Injector Retention Clip filed on Feb. 24, 2006 now U.S. Pat. No. 7,360,524 and currently pending, which is a Continuation-in-Part of Application No. 11/003,059 filed Dec. 3, 2004, now U.S. Pat. No. 7,159,570 entitled Fuel Injector Retention Clip. Both U.S. patent application Ser. No. 11/361,550 and U.S. Pat. No. 7,159,570 are hereby incorporated by reference in their entirety.

BACKGROUND OF THE INVENTION

1. Field of the Invention

The invention relates to a fuel delivery system arrangement for connecting an electric operated fuel injector between a fuel rail and an air intake of a spark-ignited, internal combustion engine.

2. Discussion of Related Art

Spark-ignited, fuel-injected internal combustion engines are often used in automotive vehicles. Fuel is injected into an intake system of such an engine by electric operated fuel injectors of a fuel rail (sometimes referred to as a fuel manifold) assembled to the engine.

Targeted types of fuel injectors inject fuel into the vehicle engine in a direction, or directions, that are other than along the fuel injector axial centerline. A split stream fuel injector is an example of a targeted fuel injector. When a targeted fuel injector is used in an engine, the fuel injector has to have a particular angular or circumferential orientation about its centerline so that the direction(s) of fuel injection will be properly targeted. Improperly targeted fuel injectors may derogate engine performance and/or compliance with applicable vehicle emission requirements.

Proper targeting of a fuel injector typically requires a proper axial positioning of the fuel injector. This is typically achieved by positioning the fuel injector nozzle, which contains one or more metering orifices from which fuel is injected into an engine, in a fixed geometric relation to a socket receptacle of the engine intake system into which the nozzle is inserted in a sealed manner. When a fuel rail containing fuel injectors that have been properly circumferentially located in respective outlet cups of the fuel rail is assembled to an engine that has injector-receiving socket receptacles, the act of inserting the nozzles into properly sealed relationship with the socket receptacles can complete proper targeting of the fuel injectors. The achievement of the correct circumferential location of the fuel injector to the fuel rail outlet cup is referred to as "clocking" the fuel injector.

A fuel rail may comprise attachment features, aperture brackets for example, with which threaded fasteners are associated to fasten the fuel rail to an engine. Once the fuel injector nozzles have seated in properly targeted positions in the socket receptacles, a need for further tightening of such fasteners in order to secure the fuel rail to the engine may induce undesired stress, distortion and/or movement. For example, if fuel injector nozzles have been seated in properly targeted positions in respective socket receptacles in engine air intake manifold runners before the fuel rail attachment fasteners have been fully torqued, the fuel rail may distort in some way, and/or there may be some relative movement between some component parts, as the fasteners are finally tightened to full installation torque. With prevailing manufacturing methods and dimensional tolerances of manufactured parts, it seems that the possibility of such distortion, or movement of component parts, at time of fuel rail assembly to an engine, cannot be totally foreclosed in all circumstances.

It has been known to mechanically retain a fuel injector in a fuel rail outlet cup by a retention clip that constrains the two against any substantial movement, both circumferentially and axially. A fuel rail that incorporates such a capability may improve serviceability should it become necessary to remove the fuel rail from an engine and thereafter reattach it.

Due to the enhanced stringency of vehicle emission requirements and the use of four valve cylinder heads with two intake ports, it is now more important than ever to insure the fuel injectors are properly clocked. Therefore the requirements that fuel injectors be properly clocked when inadvertently twisted during assembly or maintenance operations are greater than that previously required. Many prior fuel delivery system arrangements retain the fuel injector to the cup with a double C-type clamp clip. The double C-type clamp clip has a primary C clamp which engages an arcuate slot of the injector body. The primary C clamp retains the injector body in a generally axial direction. A secondary C clamp is typically provided which extends generally perpendicular from the primary C clamp. The secondary C clamp typically has slots or projections which interact with a flange portion of an outlet cup to make it a click-on type connection. The secondary C clamp will typically have a contact surface to prevent rotation of the fuel injector body with respect to the fuel injector outlet other than its desired angular position. An example of such a clip is shown in U.S. Pat. No. 5,040,512.

There has been a tendency from many of the prior clips to lose their retention with the fuel injector body when the fuel injector is inadvertently twisted during a maintenance operation or during a misassembly.

It is desirable to provide an improved fuel delivery system wherein the clip is less susceptible to being splayed open whenever a fuel injector is torqued inadvertently.

SUMMARY OF THE INVENTION

A fuel delivery system is provided. A fuel delivery system in accordance with the present invention comprises a fuel rail having an outlet opening and an outlet cup having an inlet that is insertable into the outlet opening. The cup further includes a flange wherein the flange includes at least one tab extending therefrom. The cup still further defines a vertical axis extending through the center of the inlet of the cup. The fuel delivery system further includes a fuel injector having a body with an inlet insertable within the cup. The fuel delivery system still further includes a clip having a base. The base includes an inner peripheral surface, at least a portion of which is configured for engagement with the fuel injector body when the clip is assembled with the fuel injector. The clip further includes at least one arm extending from the base in a axial direction relative to the vertical axis, the arm also including an axially extending finger configured for spring engagement with the tab of the flange of the cup. The clip is operative to limit the axial and radial movement of the fuel injector when the fuel injector is assembled with the clip and inserted in the cup.

A fuel injector clip for use in a fuel delivery system is also presented.

Other features of the invention will become more apparent from a review of the ensuing drawings and description.

BRIEF DESCRIPTION OF THE DRAWINGS

FIG. 20 is an enlarged partially sectioned perspective view of an alternate embodiment of the fuel delivery system shown in FIG. 2.

FIG. 21 is a perspective view of an exemplary embodiment of a fuel rail outlet cup shown in FIG. 20.

FIG. 22 is a perspective view of a fuel injector clip shown in FIG. 20 utilized to retain a fuel injector in the fuel rail outlet cup shown in FIG. 21.

FIGS. 23*a* and 23*b* are cross section views of the injector shown in FIG. 20 with an without the clip of FIG. 22 attached thereto taken along the line 23-23 in FIG. 20.

FIG. 26 is an enlarged partial cross section view of a portion of the clip shown in FIG. 22 showing the progression of the engagement of the clip with a portion of the cup shown in FIG. 21 along line 26-26 in FIG. 20.

FIGS. 31*a* and 31*b* are cross section views of the injector shown in FIGS. 27 and 28 with and without the clip of FIG. 30 attached thereto taken along the line 31-31 in FIG. 28.

FIGS. 32-34 are enlarged perspective views of the injector and injector clip combination being coupled together and inserted into the outlet cup shown in FIG. 29.

DETAILED DESCRIPTION OF THE INVENTION

Figure 1:
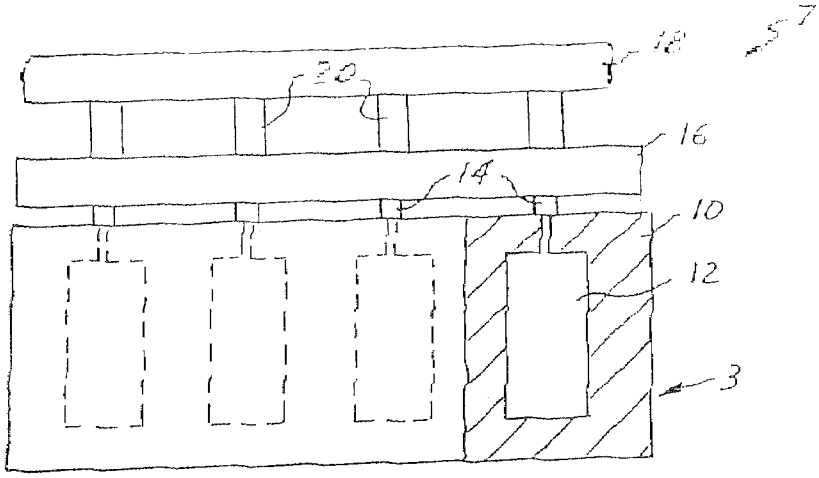
FIG. 1 is a schematic view of the internal combustion engine of the present invention.

FIG. 1 illustrates a spark-ignited, internal combustion vehicle engine 3 having an arrangement of a fuel delivery system 7 according to the present invention. The vehicle engine 3 as schematically shown has an engine block 10. The engine block 10 has a bank of combustion chambers 12. The combustion chambers 12 are fluidly connected with runners 14 of an air intake manifold 16. Connected between the air intake manifold 16 and a pressurized fuel rail 18 are a series of fuel injectors 20. The fuel injectors 20 meter fuel from the fuel rail 18 to the runners 14. In another embodiment of the present invention (not shown), the fuel injectors 20 are inserted with a passage connecting them directly with the combustion chambers 12. Typically the fuel rail 18 will be connected to the intake manifold 16 by a series of brackets (not shown). The fuel injectors 20 are typically top feed electric operated type fuel injectors. The fuel injectors may be single or multiple orifice type fuel injectors and typically will be directional type fuel injectors wherein the angular position of the fuel injectors about its longitudinal axis should be aligned with a predetermined direction to ensure proper delivery of fuel into the runners 14 of the air intake manifold 16.

Referring additionally to FIGS. 2, 3, 4 and 5 the fuel delivery system 7 of the present invention as mentioned previously includes the fuel rail 18. The fuel rail 18 has an outlet opening 24. An outlet cup 26 has a narrow portion 28 and is sealably inserted within the aforementioned fuel rail outlet opening 24. The outlet cup 26 also has an enlarged portion 30. Towards a bottom outlet end, the outlet cup 26 has a flange 32. In the embodiment shown, the flange 32 is generally perpendicular but in other embodiments the flange can be angled upward (FIGS. 6 and 7) or downward (not shown). The flange 32 of the outlet cup has a slot 34. The slot 34 also extends to a short portion of the enlarged portion 30 which is most adjacent to the flange 32.

The fuel injector has a body inlet portion 40 which has an inlet opening 42 extending therethrough. The inlet portion 40 is insertable within the cup 26. An O-ring 44 is sealably engaged with the inlet portion 40 of the fuel injector and additionally is sealably engaged with an interior inner diameter 46 of the cup. A mid portion 48 of the injector has slot grooves 50 (FIG. 5) providing flats 52. A bottom end 54 of the fuel injector body is sealably mounted by an O-ring 56 within an opening 58 of the intake manifold 16 which intersects with the runner 14.

The fuel delivery system includes an arcuate clip 60. The clip 60 functions to radially and axially retain the fuel injector 20 to the cup 26 and also functions to clock or to angularly orientate the fuel injector 20 to ensure its proper angular positional alignment along its longitudinal axis. The clip 60 has an outer periphery or circumference 62. The outer circumference 62 will be sized to be slightly greater than that than the inner diameter 46 of the cup when the clip is in its free state and slightly less when circumferentially compressed for insertion into the cup 26. The clip 60 has an inner peripheral or circumferential surface 64. The inner circumferential surface 64 of the clip has non-relative torsional engagement with the mid portion 48 of the fuel injector. The inner circumferential surface 64 has flats 66 which engage the flats 52 of the injector body. The clip 60 has an open end between the contact points 68. The distance between the contact points 68 will typically be slightly less than or the same as the width between the flats 52 of the injector body mid portion and the injector body mid portion will only come within the interior of the clip 60 by spreading apart the contact points 68. The clip 60 also has radially extending arms 70. Radially extending arms 70 each have two fingers 72 which are positioned on top of the cup flange 32.

During the assembly operation the contact points 68 are spread apart or wedged apart and ride upon the flats 52 of the fuel injector body until such time that the flats 66 are allowed to engage with the flats 52. A top or extreme sectional end of the injector body mid portion noted as item 76 (FIG. 3) can be purposely cut off so that the flats 66 cannot engage with the flats 52. Therefore an assembler by tactual touch alone will have confirmation that the fuel injector is not properly clocked and will therefore turn the fuel injector around 180 degrees to ensure its proper orientation with respect to the clip 62. The clip will be slightly compressed by appropriate tooling after being engaged with the fuel injector mid portion. The arms 70 are then aligned with the slots 34 of the injector cup and the arm 70 and finger 72 are deformed to place an orifice contact surface 78 on top of the flange 32. The fuel injector will be clocked in the correct position and the finger with contact with the flange 32 will axially and radially retain the fuel injector body in position. The slot floor and ceiling is juxtaposed by the thickness of the clip 60. The height of the slots 50 over and above that of the vertical height of the clip 60 will determine the axial play of the fuel injector with respect to the fuel rail 18.

When fuel injector 20 is assembled with clip 60 and inserted into cup 26, clip 60 is restrained within cup 26, thereby preventing clip 160 from opening. Accordingly, any inadvertent attempt to twist the fuel injector 20 will cause the clip to open up and engage the interior diameter 46 of the cup. The clip 60 will not be allowed to open up to release the fuel injector 20 unless it or the cup 26 is deformed, which will require substantial force. To release the fuel injector 20 for maintenance, the arms and fingers 72 will be deformed and removed through the slots 34.

Figure 6:
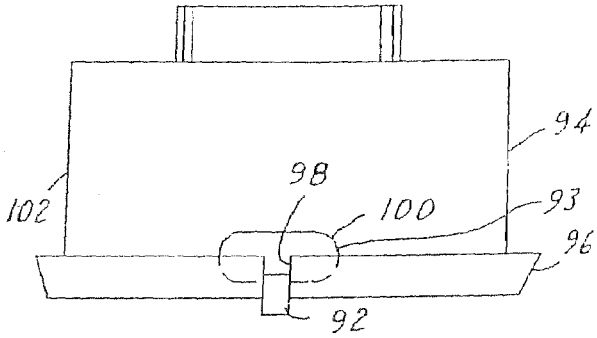
FIG. 6 is a partial side elevational view of an alternate preferred embodiment fuel delivery system according to the present invention.
Figure 7:
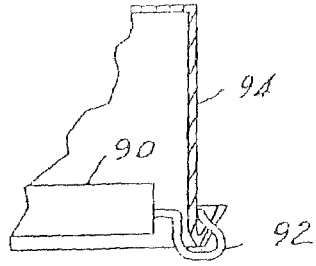
FIG. 7 is a partial sectional view of the fuel delivery system shown in FIG. 6.

Referring to FIGS. 6 and 7 an alternate preferred embodiment of the present invention has a clip 90. Clip 90 is substantially similar to clip 60 except it has a descending arm 92. A cup 94 utilized with the clip 90 has a generally upward angle flange 96 with a slot 98. The arm 92 has two projecting fingers 93 which nest between the flange 96 and the enlarged portion 102 of the cup.

Figure 2:
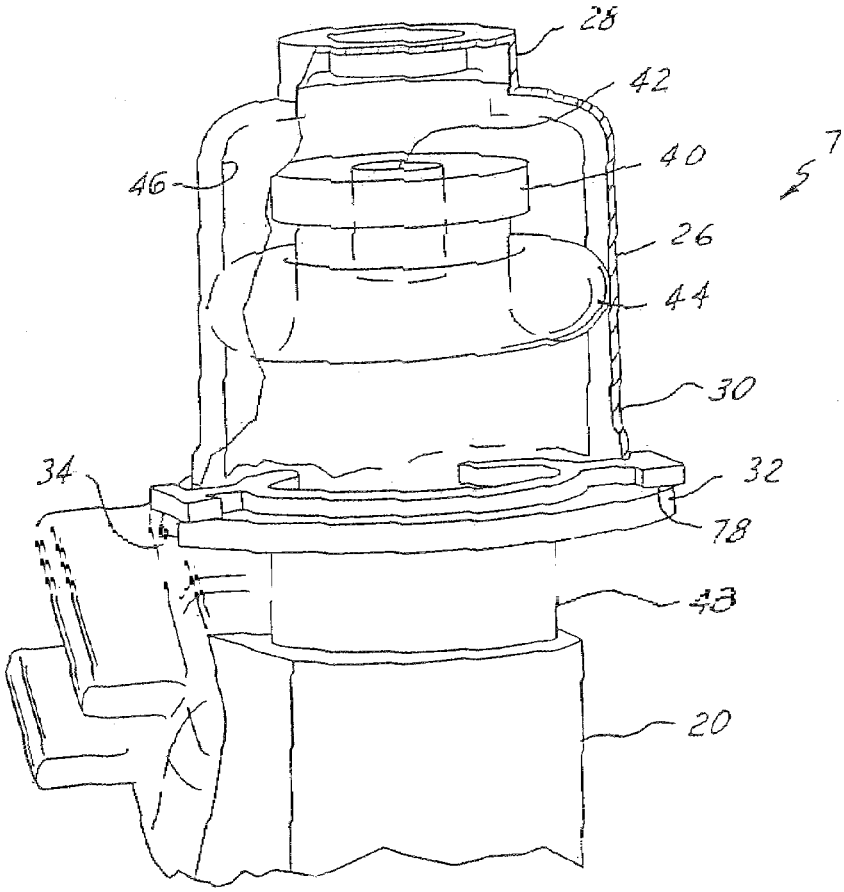
FIG. 2 is an enlarged perspective partially sectioned view of the fuel delivery system shown in FIG. 1.
Figure 4:
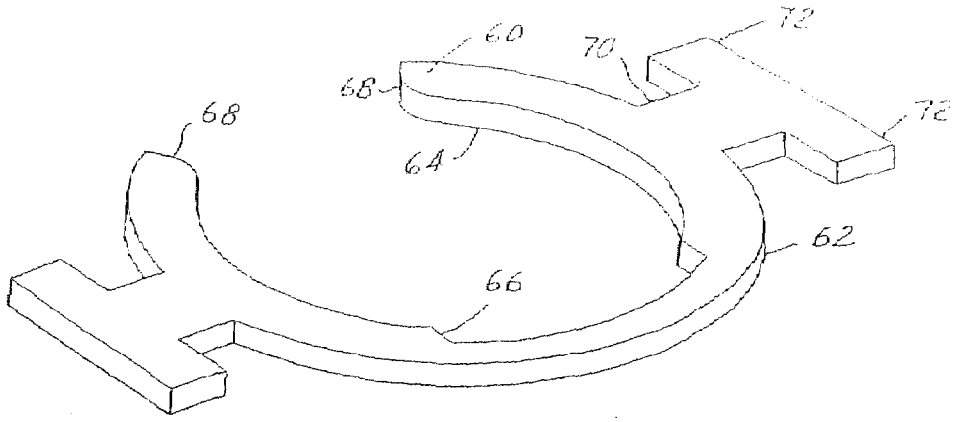
FIG. 4 is a perspective view of a clip utilizing the fuel delivery system shown in FIGS. 1-3.
Figure 3:
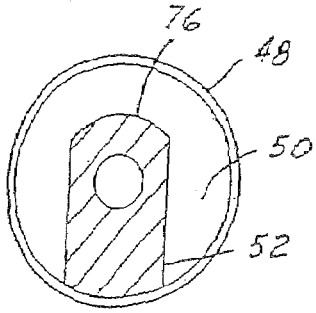
FIG. 3 is a sectional view of a fuel injector shown in FIGS. 1 and 2.
Figure 5:
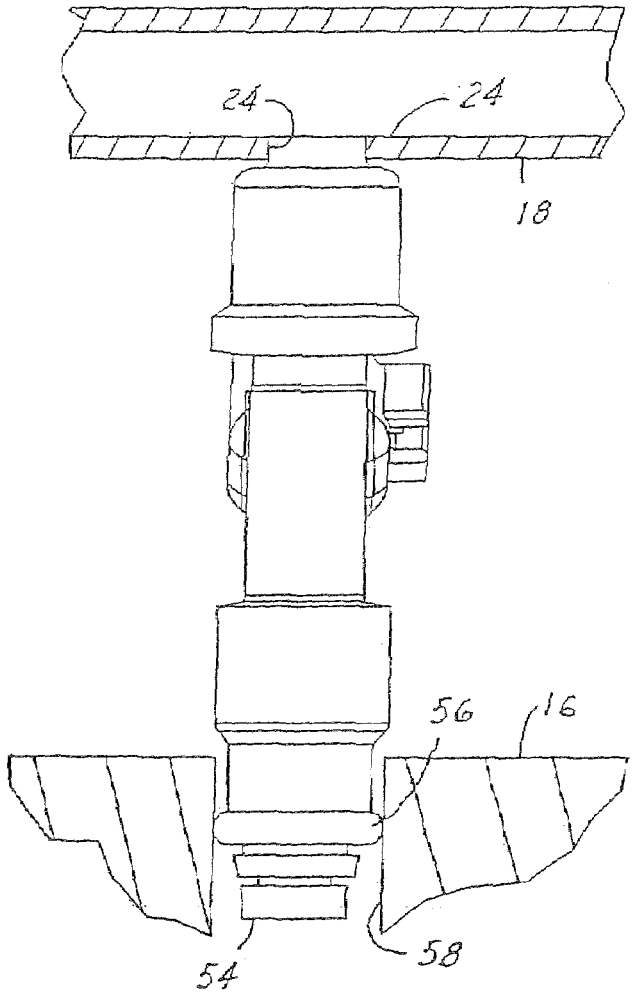
FIG. 5 is a perspective partially sectioned view of the fuel delivery system shown in FIGS. 1-4.
Figure 8:
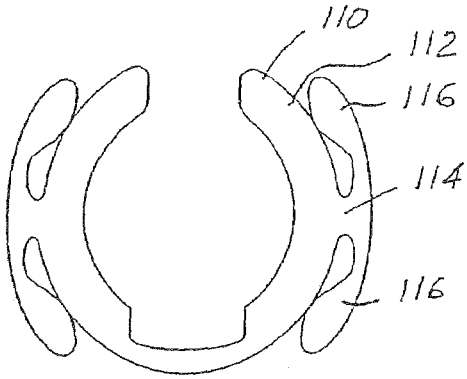
FIG. 8 is a top plan view of an alternate preferred embodiment clip to that shown in FIG. 4.
Figure 9:
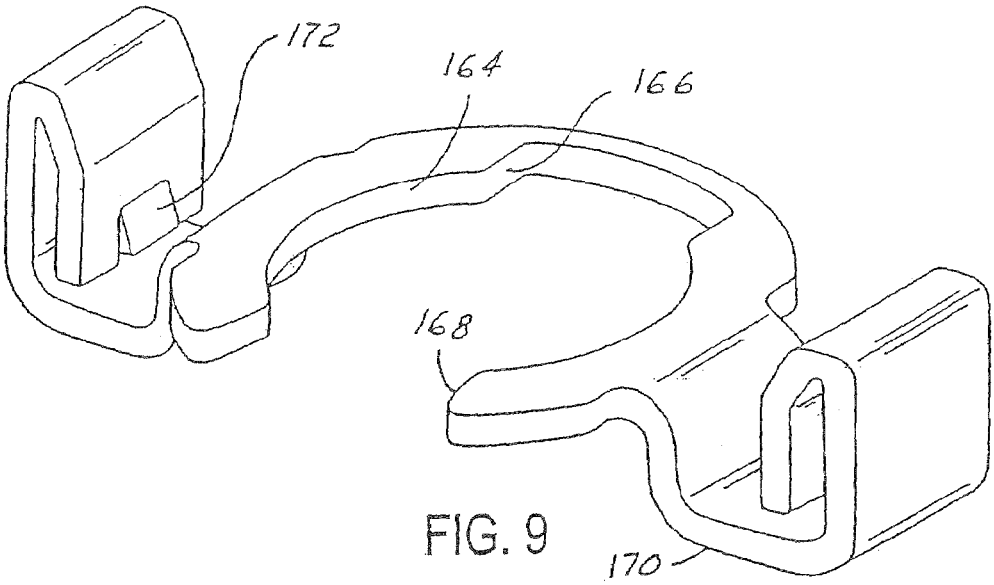
FIG. 9 is a perspective view of another alternative preferred embodiment clip to that shown in FIG. 4.
Figure 10:
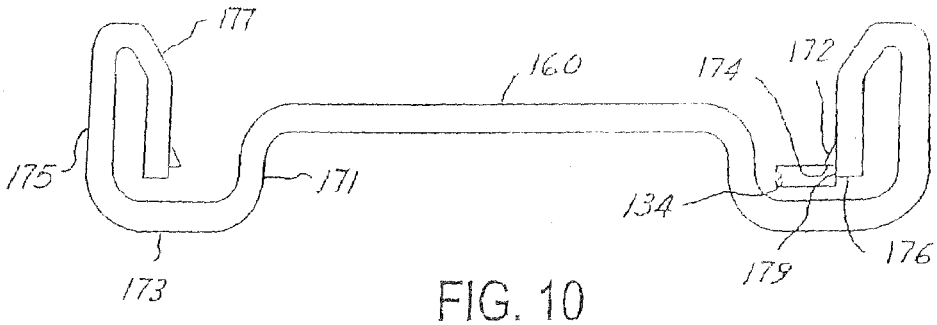
FIG. 10 is a side elevational view of the clip shown in FIG. 9.
Figure 11:
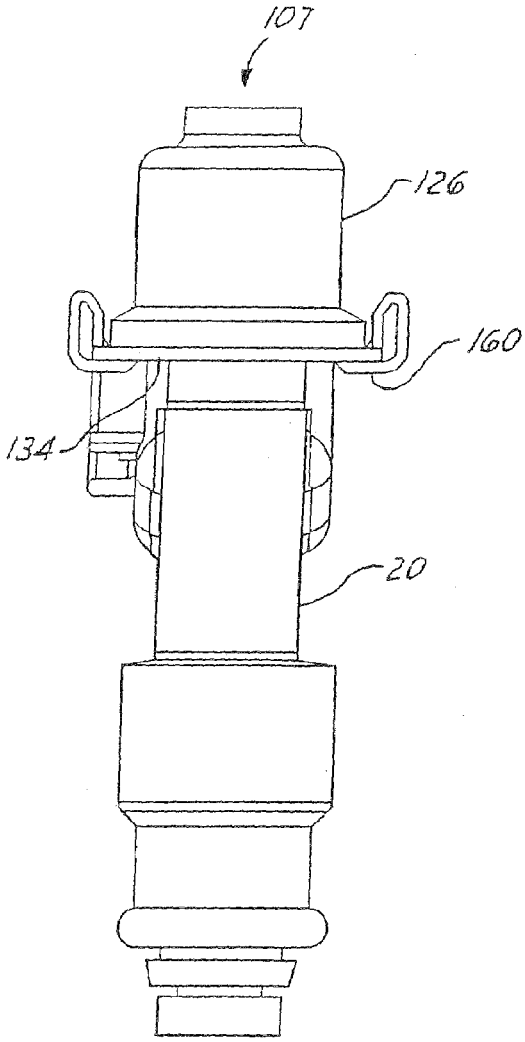
FIG. 11 is an elevational view of the clip shown in FIGS. 9-10 utilized to retain a fuel injector to a fuel rail outlet cup with portions of the cup removed for clarity of illustration.

Referring to FIG. 8 an alternate preferred embodiment clip 110 has a main body 112 substantially similar to that aforedescribed for the clip 60. The clip 110 is used with a cup 26, as shown in FIGS. 2 and 5. Additionally, the clip 60 has arms 114 having spring fingers 116. The fingers 116 compliantly engage against the outer perimeter of the cup enlarged portion 30 while additionally resting upon the cup flange 32.

Referring to FIGS. 9-12, an alternate preferred embodiment fuel delivery system includes a clip 160. The clip 160 functions to radially and axially retain a fuel injector 120 to the cup 126 and also functions to clock or to angularly orientate the fuel injector 120 to insure its proper alignment along its longitudinal axis. The clip 160 has an outer periphery 162, an inner peripheral surface 164, flats 166 and an open end between contact points 168, essentially similar to or identical to the aforedescribed items in regards to the clip 60 previously described.

Clip 160 has radially extending arms 170 which include a downwardly extending portion 171, a base portion 173, an upward extending portion 175 and a downwardly extending portion 177. The arms have a flared finger 172 which has a generally horizontal downward facing contact surface 174. The shoulder also provides a generally vertical radially inward contact surface 179.

Figure 12:
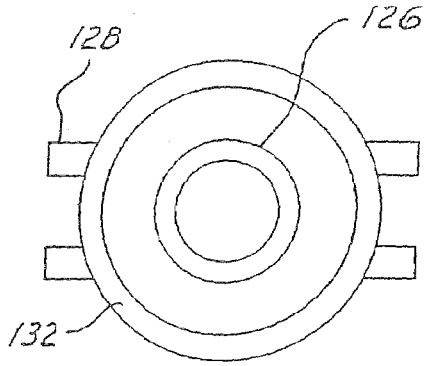
FIG. 12 is a top plan view of the fuel rail cup utilized in the fuel delivery system shown in FIG. 11.

The cup flange 132 has generally radial projections 128 (shown only in FIG. 12). The projections 128 set the radial position of the clip 160 with respect to the cup 126. The arms 170 have spring engagement with the flange 132 of the cup and the spring engagement has both a vertical and horizontal component due to the contact of the contact surfaces 177, 174 with the flange 132. Accordingly, when fuel injector 20 is assembled with clip 160 and inserted into cup 126, the arrangement of arms 170 and flange 132, combined with a portion of clip 160 being disposed within cup 126, restrains clip 160 and prevents it from opening. When it is desirable to disassemble a fuel injector from the fuel rail, the downward extending portion 177 of the clip can be pushed outward to release the clip from the cup flange 132.

Figure 13:
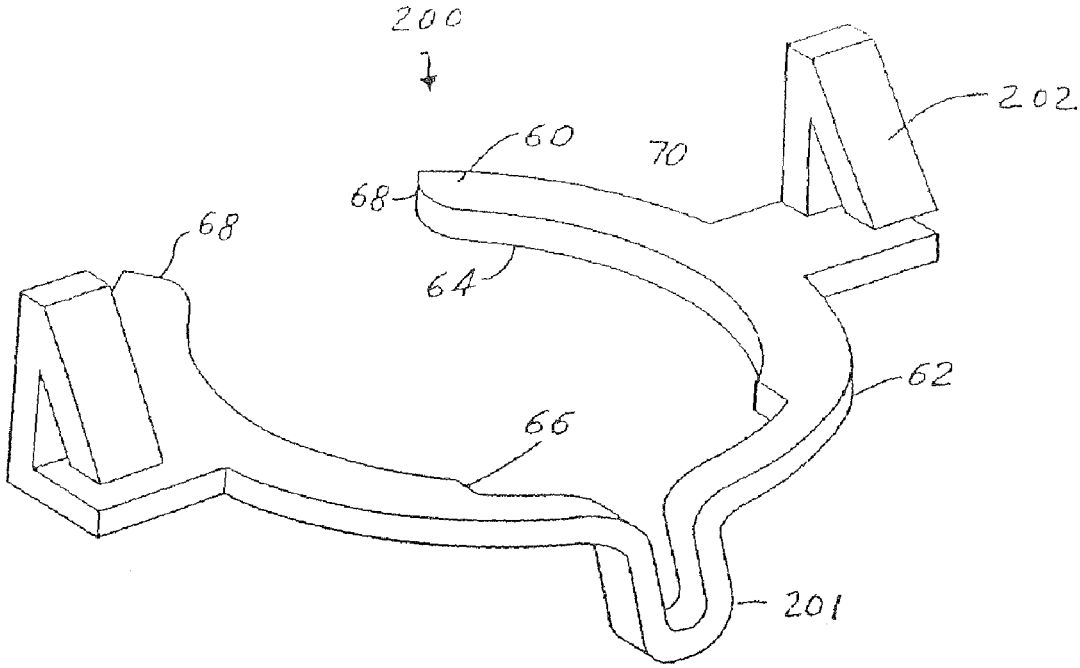
FIG. 13 is a perspective view of another alternative preferred embodiment clip to that shown in FIG. 4.

Referring to FIG. 13 an alternate preferred embodiment clip 200 is provided. The clip 200 has a wishbone bend 201. The bend 201 allows the clip to be removable by hand or without the use of specialized tooling. The wishbone bend 201 also allows the clip 200 to bend without permanent deformation therefore it can be reused. The clip 200 has bent over arms 202 which after installation extend over the top of the flange. The reminder to the clip 200 is similar if not identical to the clip 60.

Figure 14:
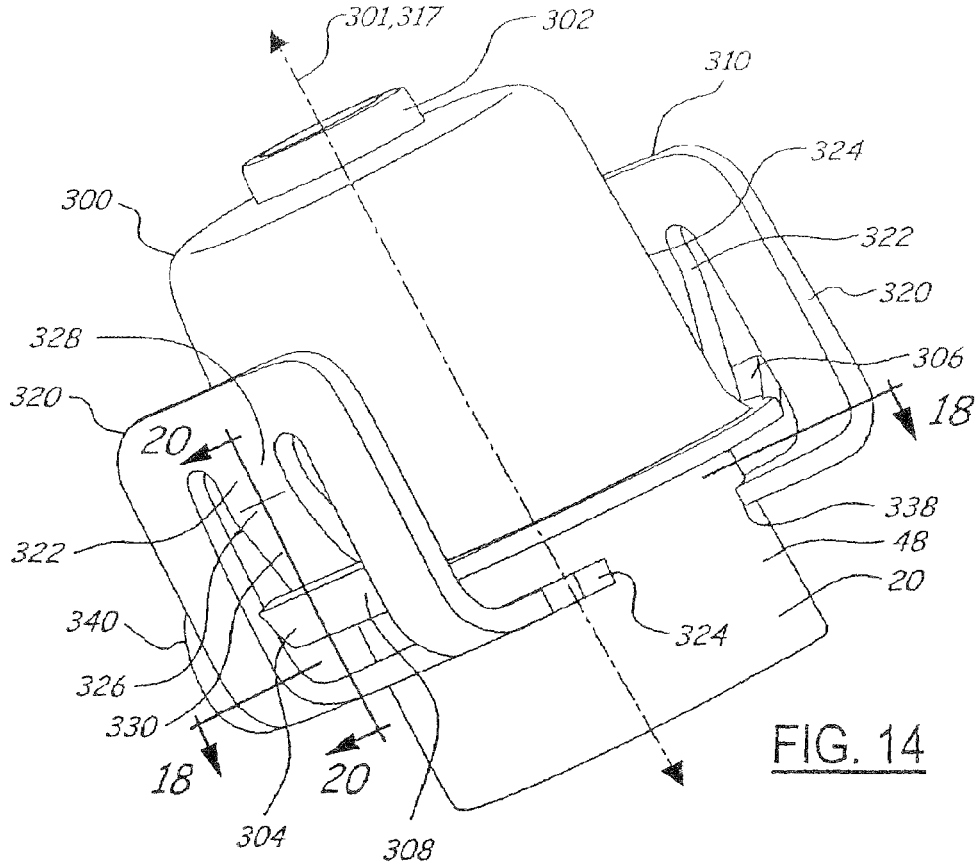
FIG. 14 is an enlarged partially sectioned perspective view of an alternate embodiment of the fuel delivery system shown in FIG. 2.

FIGS. 14-19 illustrate yet another embodiment of fuel delivery system 7 (best shown in FIG. 2). FIG. 14 illustrates a partial perspective view of an assembled fuel delivery system in accordance with this embodiment of the invention. In this embodiment, fuel delivery system 7 (best shown in FIG. 2) includes an outlet cup 300 that is insertable into outlet opening 24 of fuel rail 18.

Figure 15:
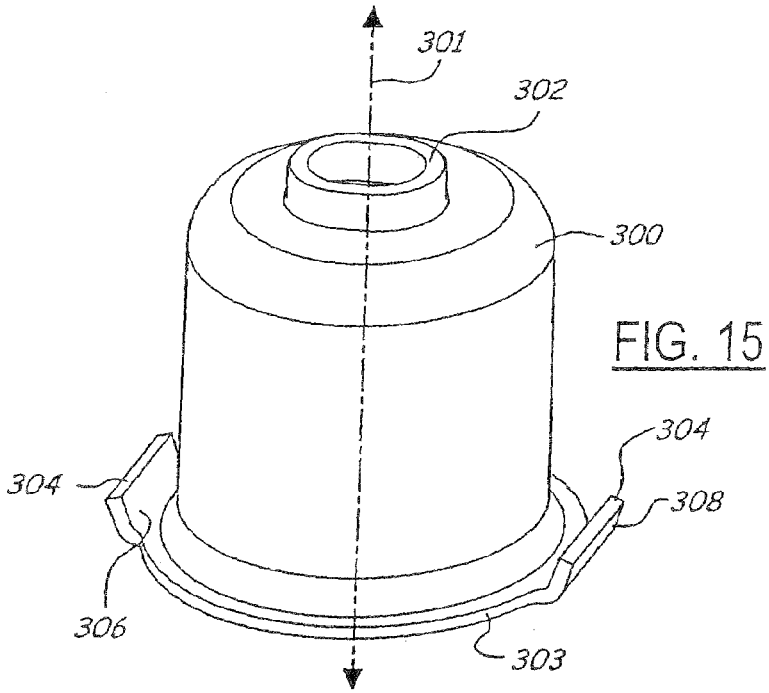
FIG. 15 is a perspective view of an exemplary embodiment of a fuel rail outlet cup shown in FIG. 14.
Figure 18:
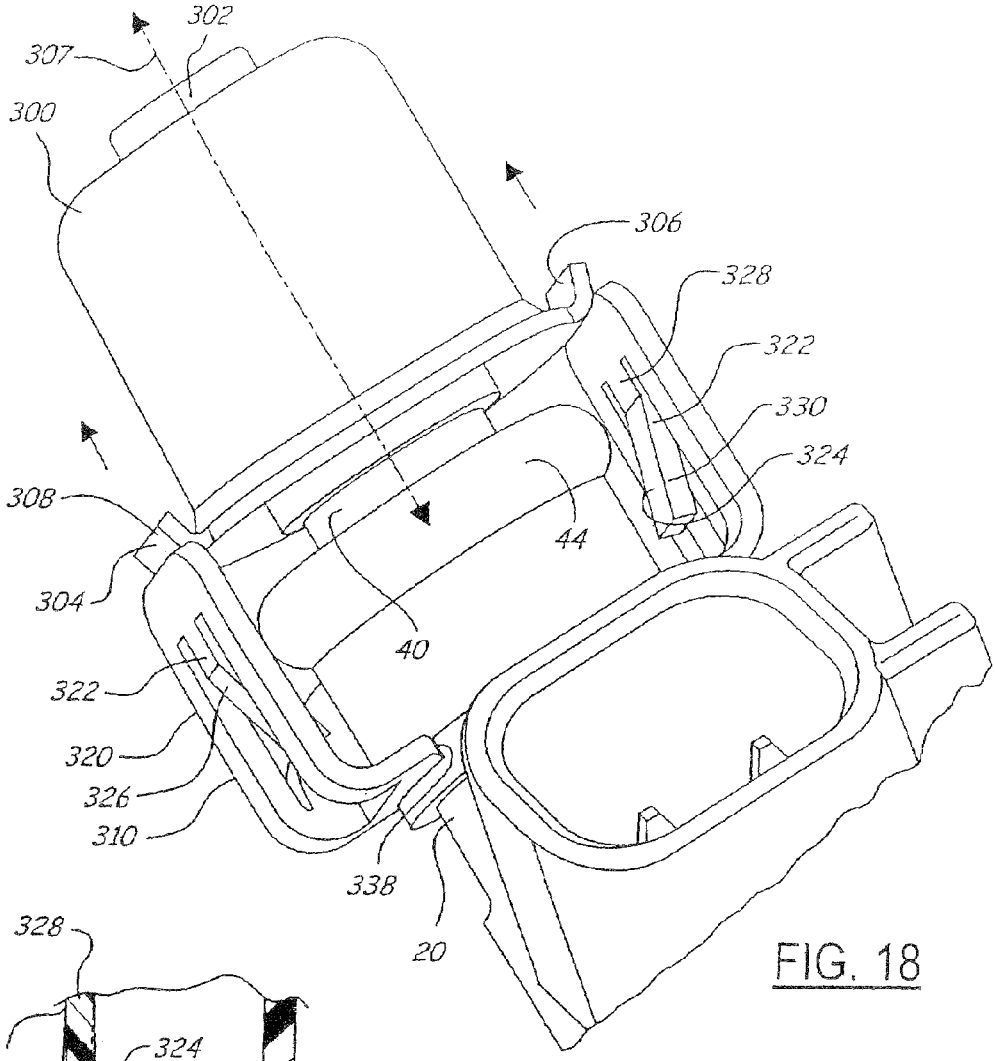
FIG. 18 is an enlarged partially sectioned perspective view of the injector and injector clip combination being inserted into the outlet cup shown in FIG. 15.

With reference to FIG. 15, cup 300 defines a vertical axis 301 extending therethrough, has an inlet 302 at a first axial end of cup 300 and that is insertable into fuel rail outlet opening 24. Cup 300 is configured to receive the inlet portion 40 of a fuel injector 20. As shown in FIG. 18 and as discussed above, an O-ring 44 is sealably engaged with inlet portion 40 and is configured to be sealably engaged with an interior portion of cup 300. Cup 300 further includes a flange 303. Flange 303 includes a pair of tabs 304 disposed at diametrically opposite sides of cup 300. Tabs 304 extend upwards towards the first axial end, away from flange 303 at a predetermined angle. Tabs 304 each include an inner surface 306 and an outer surface 308.

Figure 16:
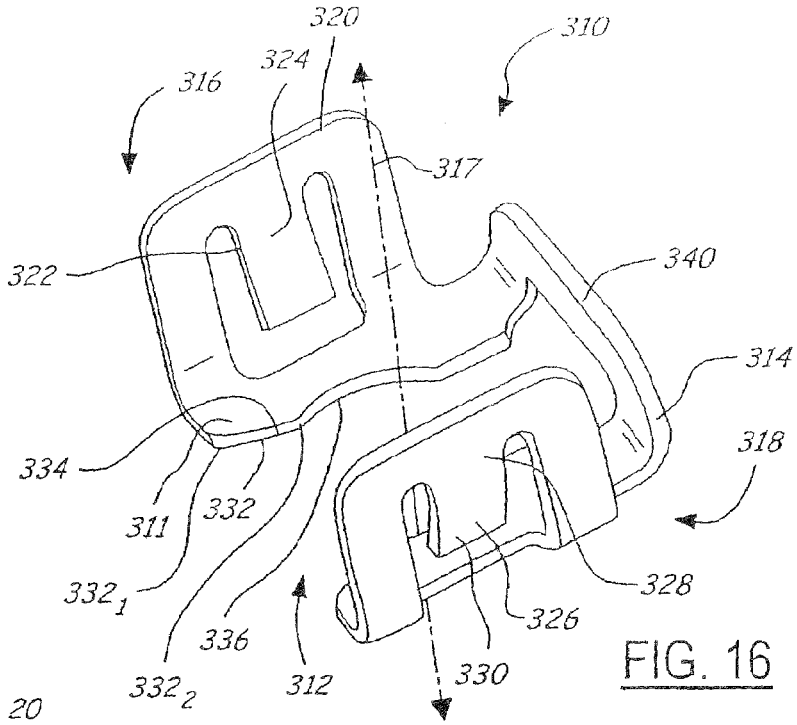
FIG. 16 is a perspective view of a fuel injector clip shown in FIG. 14 utilized to retain a fuel injector in the fuel rail outlet cup shown in FIG. 15.

With reference to FIG. 16, fuel delivery system 7 further includes a fuel injector clip 310. Clip 310 has a base 311, which in turn includes an open end 312, a closed end 314 opposite open end 312, a first side 316 and a second side 318 opposite first side 316. Clip 310 defines a vertical axis 317 extending through the center thereof, and further comprises at least one arm 320 extending upwards in an axial direction relative to axis 317. Preferably, however, clip 310 comprises a pair of arms 320, one on either side 316, 318 of clip 310. It should be noted that clips having fewer or more arms remain within the spirit and scope of the present invention. In one preferred embodiment, each arm 320 takes the form of an upside-down "U", with a finger 322 extending downwards from the center of the base portion of the "U" in an axial direction relative to axis 317. Finger 322 has an inner surface 324, an outer surface 326, a generally vertical portion 328 that is substantially parallel to arm 320, and a generally angled portion 330 that angles from a vertical portion 328 towards the inner periphery of clip 310, and base 311 in particular, at a predetermined angle that, in one preferred embodiment, is equal to the angle of tabs 304. Fingers 322 are configured such that when fuel injector 20 is coupled with clip 310 and inserted into cup 300, each finger 322 "snaps" over and engages with a corresponding tab 304 so as to retain injector 20 within cup 300 (best shown in FIGS. 18 and 19).

With continued reference to FIG. 16, base 311 of clip 310 includes an inner peripheral surface 332. Inner surface 332 includes a pair of angled portions 334 disposed at open end 312 of clip base 311 and a pair of arcuate recessed portions 336, one of which is located on side 316 of clip 310 and the other of which is located on side 318 of clip 310 (not shown). Angled portions 334 are such that the opening of clip base 311 tapers inwardly (i.e., reducing the width of the opening) from the radial outermost point $\mathbf{332}_1$ of inner surface 332 to a point $\mathbf{332}_2$ disposed at a first end of each recessed portion 336. Recessed portions 336 are configured in size, shape and location on clip 310 to engage corresponding mating grooves 338 in mid-portion 48 of the body of fuel injector 20 (best shown in FIGS. 17*a*-17*b*). Grooves 338 are disposed about the outer circumference of the body of fuel injector 20 at diametrically opposite sides of injector 20 and have a slightly greater arcuate length than that of the arcuate portions 336 of clip 310.

Figure 17A:
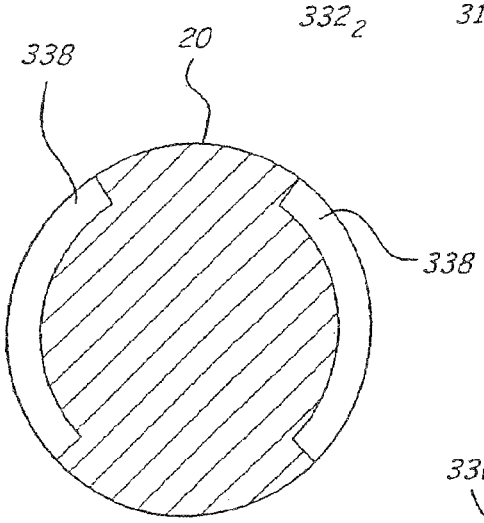
FIGS. 17*a* and 17*b* are cross section views of the injector shown in FIG. 14 with and without the clip of FIG. 16 attached thereto taken along the lines 17-17 in FIG. 14.
Figure 17B:
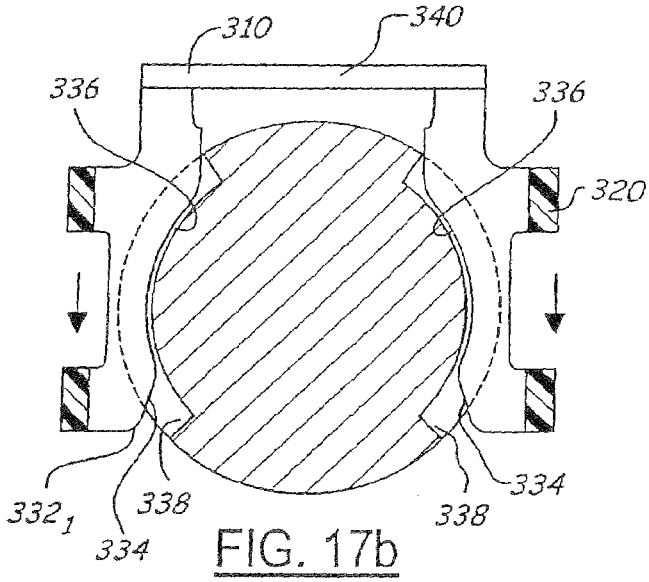

With reference to FIGS. 14 and 17*b*-19, the coupling of clip 310 and injector 20 together (FIG. 17*b*), and the insertion of the clip/injector combination into cup 300 (FIGS. 14 and 18-19) will be described. As shown in FIG. 17*b*, to assemble clip 310 and injector 20 together, the inner surface 332, and arcuate portions 336 in particular, are radially aligned relative to axis 317 with grooves 338 of injector 20. Clip 310 is then pushed and slid onto injector 20 in a radial direction. As clip 310 is pushed against the body of injector 20, injector 20 slides against angled portions 334 of inner surface 332, forcing the opening at open end 312 to deflect and widen to accommodate the size of injector 20. Once recessed arcuate portions 336 and grooves 338 meet and are aligned, the arcuate portions 336 are seated in grooves 338. Once clip 310 is engaged with grooves 338 of injector 20, the opening of clip 310 reflects back to at least close to its original width. To remove injector 20 from clip 310, the opening at open end 312 is pulled open and the injector is removed.

With reference to FIG. 18, once clip 310 and injector 20 are assembled together, the clip/injector combination is inserted into cup 300. When the combination is inserted, fingers 322 of clip 310 are aligned with tabs 304. As the combination is pressed into cup 300 in an axial direction relative to axis 301, the inner surface 324 of each finger 322 engages the outer surface 308 of the respective tab 304.

Figure 19:
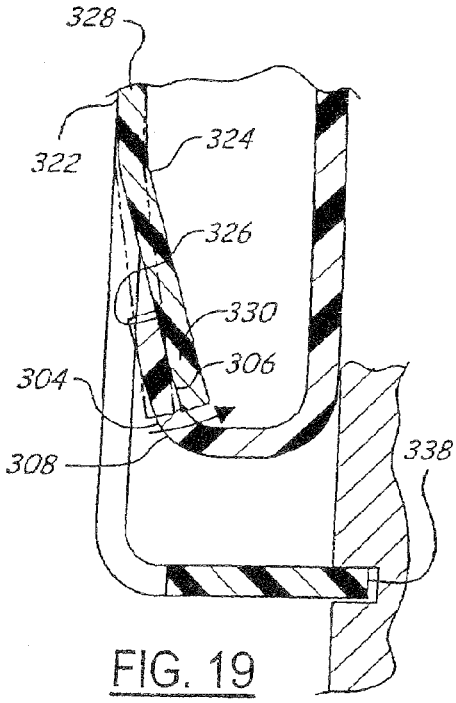
FIG. 19 is an enlarged partial cross section view of a portion of the clip shown in FIG. 16 showing the progression of the engagement of the clip with a portion of the cup shown in FIG. 15 along line 19-19 in FIG. 14.

With reference to FIG. 19, as the combination continues to be inserted, fingers 322 continue to ride along tabs 304 in a camming fashion and the force applied to fingers 322 by tabs 304 deflects fingers 322 in a radially outward direction relative to the interior of cup 300. This deflection continues until the end or bottom of fingers 322 is reached and the engagement between the inner surface 324 of fingers 322 and the outer surface 308 of tab 304 is broken. At the instant this engagement is broken, fingers 322 decompress and snap over the respective tabs 304 such that the outer surfaces 326 of fingers 322 are spring engaged with the respective inner surfaces 306 of tabs 304. Once this "snapping" occurs, injector 20 is fully inserted into cup 300, and the engagement of fingers 322 and tabs 304 axially retains the injector in position (best shown in FIG. 14). Accordingly, as the combination of clip 310 and injector 20 are inserted into cup 300, fingers 322 are deflected from an original position shown in phantom lines in FIG. 19 to a deflected or engaged position shown in solid lines in FIG. 19. Once the combination of clip 310 and fuel injector 20 are assembled with cup 300, the arrangement of arms 320 and fingers 322 with tabs 304 of cup 300 restrains clip 310 outside of cup 300, thereby preventing clip 310 from opening.

FIG. 16 shows that clip 310 further includes an additional member 340 disposed at closed end 314 of clip 310 extending vertically from base 311 along axis 317 that is smaller in size than arms 320. Member 340 of clip 310 is configured to allow the closed end 314, or back portion of clip 310, to bend to facilitate the sliding installation of clip 310 on fuel injector 20 without permanent distortion of clip 310. Member 340 also functions to contact the electrical connector of injector 20 to keep clip 310 from separating from injector 20 when the connector is engaged, as well as to mate against a portion of cup 300 or fuel injector 20 to prevent the injector from rotating.

When clip 310 is assembled with fuel injector 20 and fuel injector 20 is inserted into cup 300, clip 310 limits the axial and torsional movement of fuel injector 20 and holds fuel injector 20 in place. As torque is applied to injector 20, clip 310 will rotate slightly in the grooves 338 until it strikes the ends or limits of grooves 338. Any further rotation past this point will apply a force to enlarge the open end 312 of base 311. Arms 320 of clip 310 restrict this movement when engaged with the tabs 304 of cup 300. Additionally, fuel injector 20 cannot be removed from cup 300 without disengaging clip 310 from cup 300. Accordingly, once injector 20 is clocked, it will remain so until the clip is removed from the cup.

FIGS. 20-26 illustrate yet still another embodiment of fuel rail delivery system 7 (best shown in FIG. 2) that closely resembles the embodiment depicted in FIGS. 14-19, but that differs in a number of respects. FIG. 20 illustrates a partial perspective view of an assembled fuel delivery system in accordance with this embodiment of the invention. In this embodiment, fuel delivery system 7 includes an outlet cup 400 that is insertable into outlet opening 24 of fuel rail 18 (best shown in FIG. 2).

Figure 24:
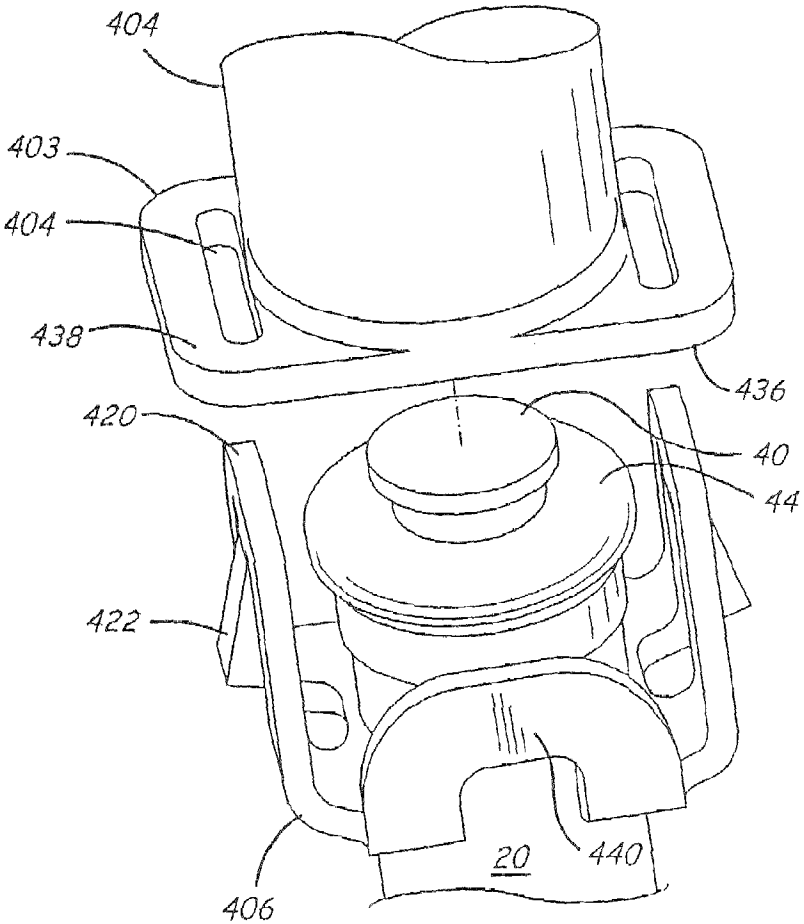

With reference to FIG. 21, cup 400 defines a vertical axis 401 extending therethrough, and has an inlet 402 at a first axial end that is insertable into fuel rail outlet opening 24. Cup 400 is configured to receive the inlet portion 40 of a fuel injector 20. As shown in FIG. 24 and as discussed above, an O-ring 44 is sealably engaged with inlet portion 40 and is configured to be sealably engaged with an interior portion of cup 400. Cup 400 further includes a flange 403. In the illustrated embodiment, flange 403 includes a pair of slots 404 disposed therein on diametrically opposite sides of cup 400. It should be noted, however, that while two slots are shown in the illustrated embodiment, a flange 403 having fewer or more slots remains within the spirit and scope of the present invention.

With reference to FIG. 22, fuel delivery system 7 further includes a fuel injector clip 406. Clip 406 has a base 408, which in turn includes an open end 410, a closed end 412 opposite open end 410, a first side 414, and a second side 416 opposite first side 414. Clip 406 defines a vertical axis 418 extending through the center thereof, and further comprises at least one arm 420 extending upwards in an axial direction relative to axis 418. Preferably, however, clip 406 comprises a pair of arms 420, one on either side 414, 416 of clip 406. In actuality, as will be discussed in greater detail below, the number of arms 420 is dependent upon the number of slots 404 in flange 403 of cup 400. Accordingly, embodiments having more or fewer than two slots 404 and corresponding arms 420 remain within the spirit and scope of the present invention. In one preferred embodiment, each arm 420 takes the form of an upside-down "U," with a finger 422 extending downwards in an axial direction relative to axis 418 from the center of the base portion of the "U." As will be discussed in greater detail below, arms 420 have both a length and width that corresponds to the length and width of slots 404 so as to facilitate the insertion of arms 420 into slots 404.

With reference to FIG. 21, cup 400 defines a vertical axis 401 extending therethrough, and has an inlet 402 at a first axial end that is insertable into fuel rail outlet opening 24. Cup 400 is configured to receive the inlet portion 40 of a fuel injector 20. As shown in FIG. 24 and as discussed above, an O-ring 44 is sealably engaged with inlet portion 40 and is configured to be sealably engaged with an interior port of cup 400. Cup 400 further includes a flange 403. In the illustrated embodiment, flange 403 includes a pair of slots 404 disposed and contained therein on diametrically opposite sides of cup 400. II should be noted, however, that while two slots are shown in the illustrated embodiment, a flange 403 having fewer or more slots remains within the spirit and scope of the present invention.

Figures 23A, 23B, 32:
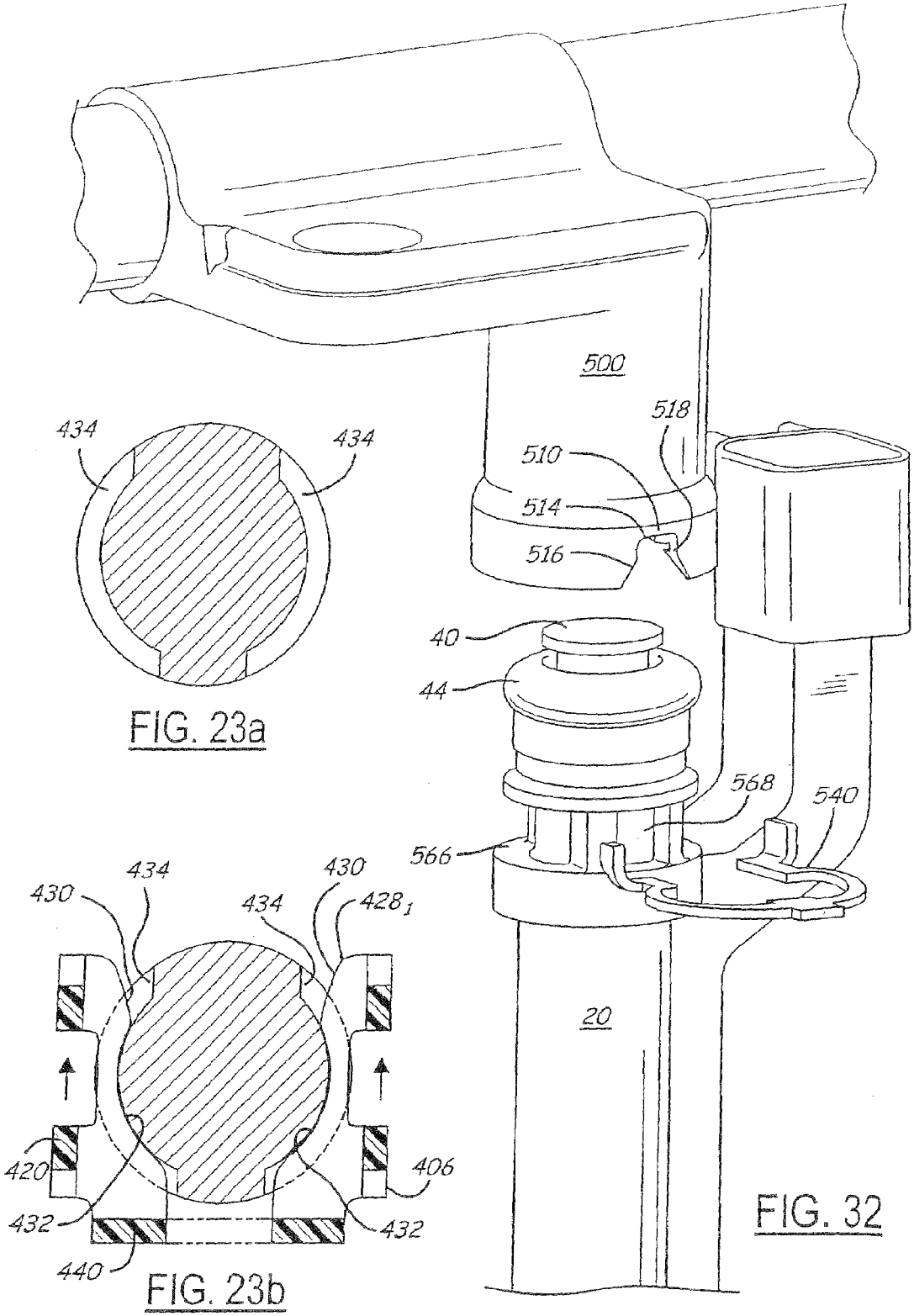

With continued reference to FIG. 22, base 408 of clip 406 includes an inner peripheral surface 428. Inner surface 428 includes a pair of angled portions 430 disposed at open end 410 of clip base 408 and a pair of arcuate recessed portions 432, one on either side 414, 416 of base 408. Angled portions 430 are such that the opening of clip base 408 tapers inwardly (i.e., reducing the width of the opening) from the radial outermost point $\mathbf{428}_1$ of inner surface 428 to a point $\mathbf{428}_2$ disposed at a first end of each recessed portion 432. As shown in FIGS. 23*a*-23*b*, recessed portions 432 are configured in size, shape and location on clip 406 to engage corresponding mating grooves 434 in mid-portion 48 of the body of fuel injector 20. Grooves 434 are disposed about the outer circumference of the body of fuel injector 20 at diametrically opposite sides of injector 20 and have a slightly greater arcuate length than that of the arcuate portions 432 of clip 406.

With reference to FIGS. 20 and 23*b*-26, the coupling of clip 406 and injector 20 together (FIG. 23*b*), and the insertion of the clip/injector combination into cup 400 (FIGS. 20 and 24-26) will be described. As shown in FIG. 23*b*, to assemble clip 406 and injector 20 together, the inner surface 428, and arcuate portions 432, in particular, are radially aligned relative to axis 418 with grooves 434 of injector 20. Clip 406 is then pushed and slid onto injector 20 in a radial direction. As clip 406 is pushed against the body of injector 20, injector 20 slides against angled portions 430 of inner surface 428, forcing the opening at open end 410 to radially deflect and widen to accommodate the size of injector 20. Once recessed arcuate portions 432 and grooves 434 meet and are aligned, the arcuate portions 432 are seated in grooves 434. Once clip 406 is engaged with grooves 434, the opening of clip 406 reflects back to at least close to its original width. To remove injector 20 from clip 406, the opening at open end 410 is pulled open and the injector is removed.

Figure 25:
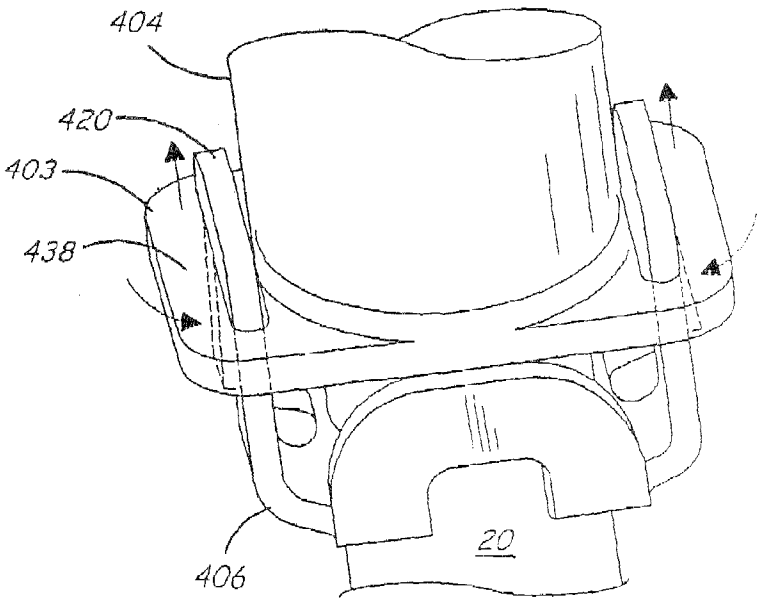
FIGS. 24 and 25 are enlarged perspective views of the injector and injector clip combination being inserted into the outlet cup shown in FIG. 21.
Figures 26, 33:
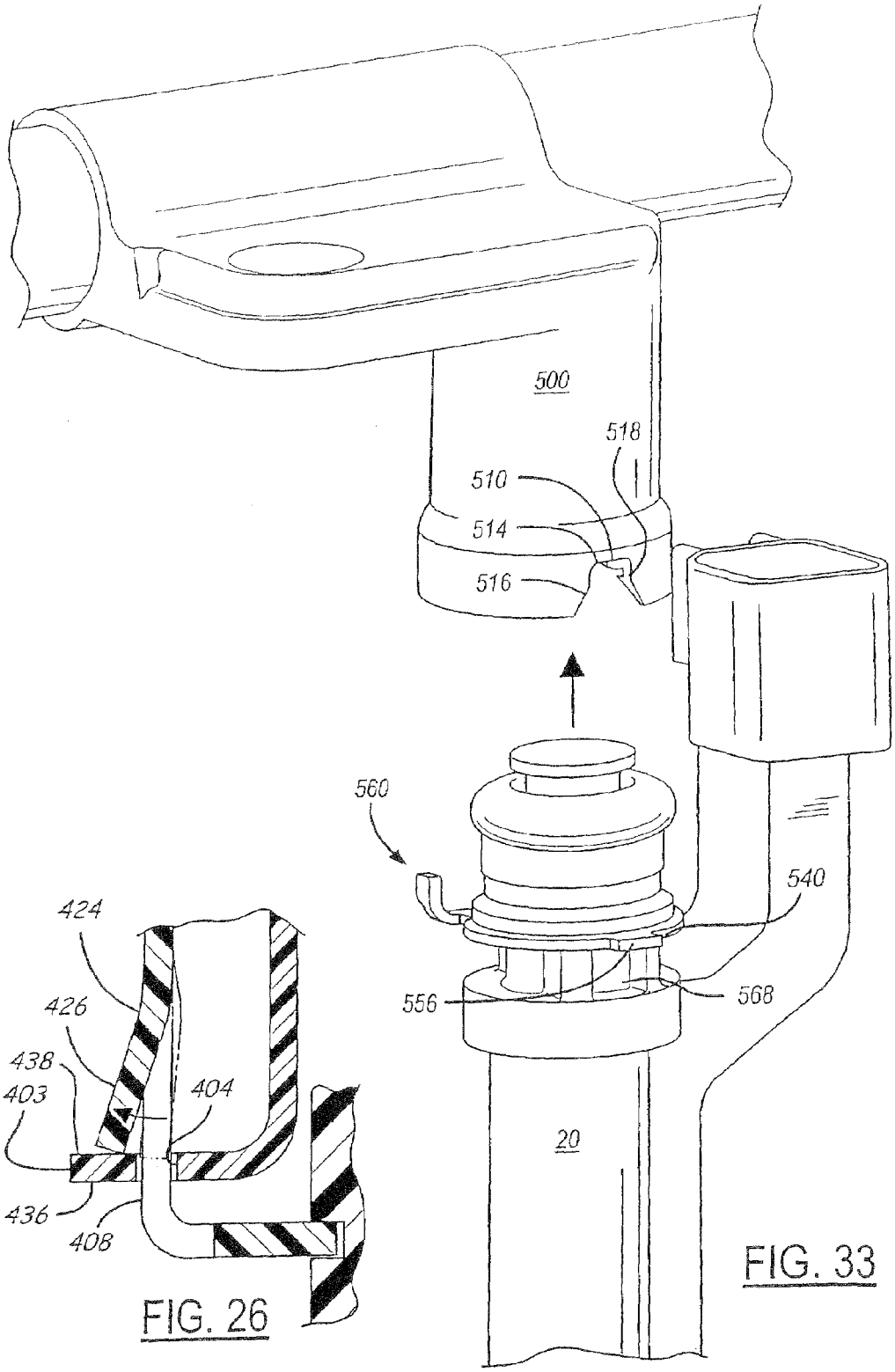

With reference to FIGS. 24-26, once clip 406 and injector 20 are assembled together, the combination is inserted into cup 400. To do so, arms 420 of clip 406 are aligned with slots 404 in flange 403 of cup 400. As the combination moves toward cup 400, arms 420 are inserted into slots 404, which, as set forth above, are sized so as to facilitate the insertion of arms 420 into slots 404. As shown in FIG. 26, as the clip/injector combination is inserted further, the outer surface of fingers 422 make contact with the underside 436 of flange 403. As the combination continues to be inserted, fingers 422 continue to ride along the underside 436 and inner wall of slots 404 in a camming fashion. As shown in FIG. 25, the force applied to fingers 422 by flange 403 deflects fingers 422 in a radially inward direction relative to the interior of cup 400 from an original position shown in solid lines to a deflected position shown in phantom lines. This deflection continues until fingers 422 are completely inserted through slots 404, causing the engagement between the inner wall of slots 404 and fingers 422 to break. At the instant the engagement is broken, fingers 422 decompress and snap out of slots 404 in a radially outward direction. Once this "snapping" occurs, injector 20 is fully inserted into cup 400. The engagement of fingers 422 with the top side 438 of flange 403 axially retains injector 20 in position, while the arrangement of arms 420 in slots 404 serves to radially retain injector 20 in position (best shown in FIG. 20). Accordingly, as the combination of clip 406 and injector 20 are inserted into cup 400, fingers 422 are deflected from an original position shown in phantom lines in FIG. 26 to an engaged position shown in solid lines in FIG. 26. Once the combination of clip 406 and fuel injector 20 are assembled with cup 400, the arrangement of arms 420 and fingers 422 with flange 403 of cup 400 restrains clip 406 outside of cup 400, thereby preventing clip 406 from opening.

FIG. 22 shows that clip 406 further includes an additional member 440 disposed at closed end 412 of clip 406 extending vertically from base 408 along axis 418 that is smaller in size than arms 420. Member 440 is configured to allow the closed end 412, or back portion of clip 406, to bend to facilitate the sliding installation of clip 406 one fuel injector 20 without permanent distortion of clip 406. Member 440 also functions to contact the electrical connector of injector 20 to keep clip 406 from separating from injectors 20 when the connector is engaged, as we all as to mate against a portion of cup 400 or fuel injector 20 to prevent the injector from rotating.

When clip 406 is assembled with fuel injector 20 and fuel injector 20 is inserted into cup 400, clip 406 limits the axial and torsional movement of fuel injector 20 and retains fuel injector 20 in place. As torque is applied to injector 20, clip 406 will rotate slightly in the grooves 434 of injector 20 until it strikes the ends or limits of grooves 434. Any further rotation past this point will apply a force to enlarge the open end 410 of base 408. Arms 420 that are disposed within slots 404 of cup flange 403 restrict this movement. Additionally, fuel injector 20 cannot be removed from cup 400 without disengaging clip 406 from cup 400. Accordingly, once injector 20 is clocked, it will remain so until the clip is removed from the cup.

Figure 28:
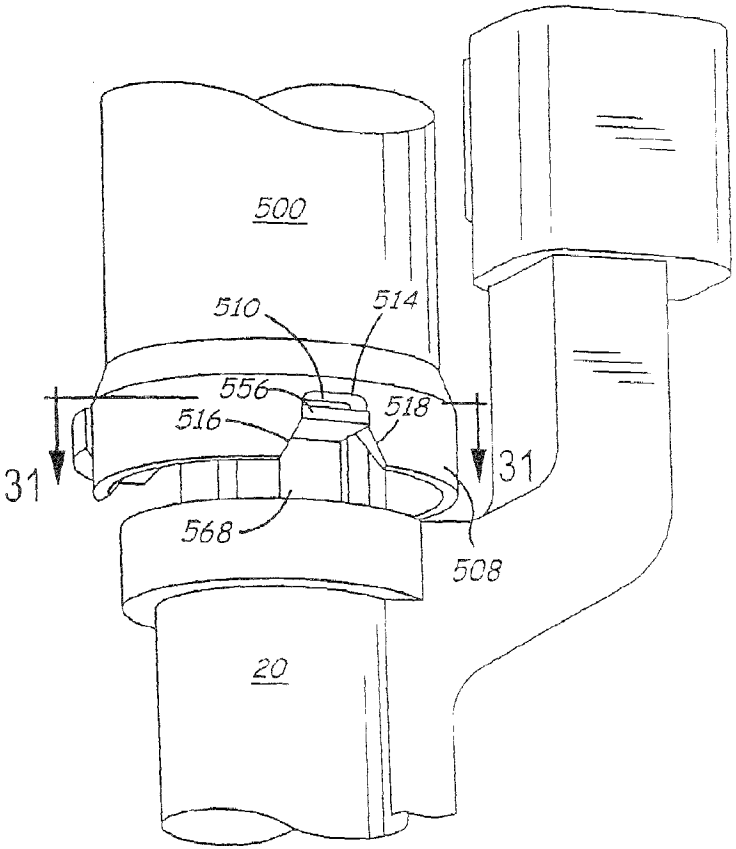
FIGS. 27 and 28 are enlarged partially sectioned perspective views of an alternate embodiment of the fuel delivery system shown in FIG. 2.
Figure 27:
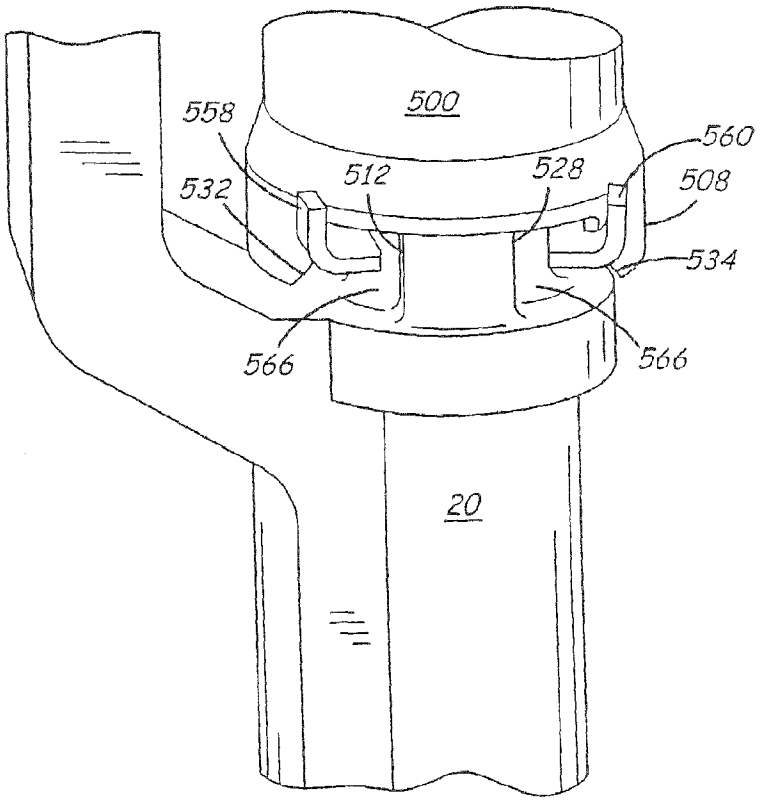

FIGS. 27-34 illustrate yet another further exemplary embodiment of fuel delivery system 7 (best shown in FIG. 2). FIGS. 27 and 28 illustrate partial perspective views of an assembled fuel delivery system in accordance with this embodiment of the invention. In this embodiment, fuel delivery system 7 includes an outlet cup 500 that is insertable into opening 24 of fuel rail 18 (best shown in FIG. 2).

Figure 29:
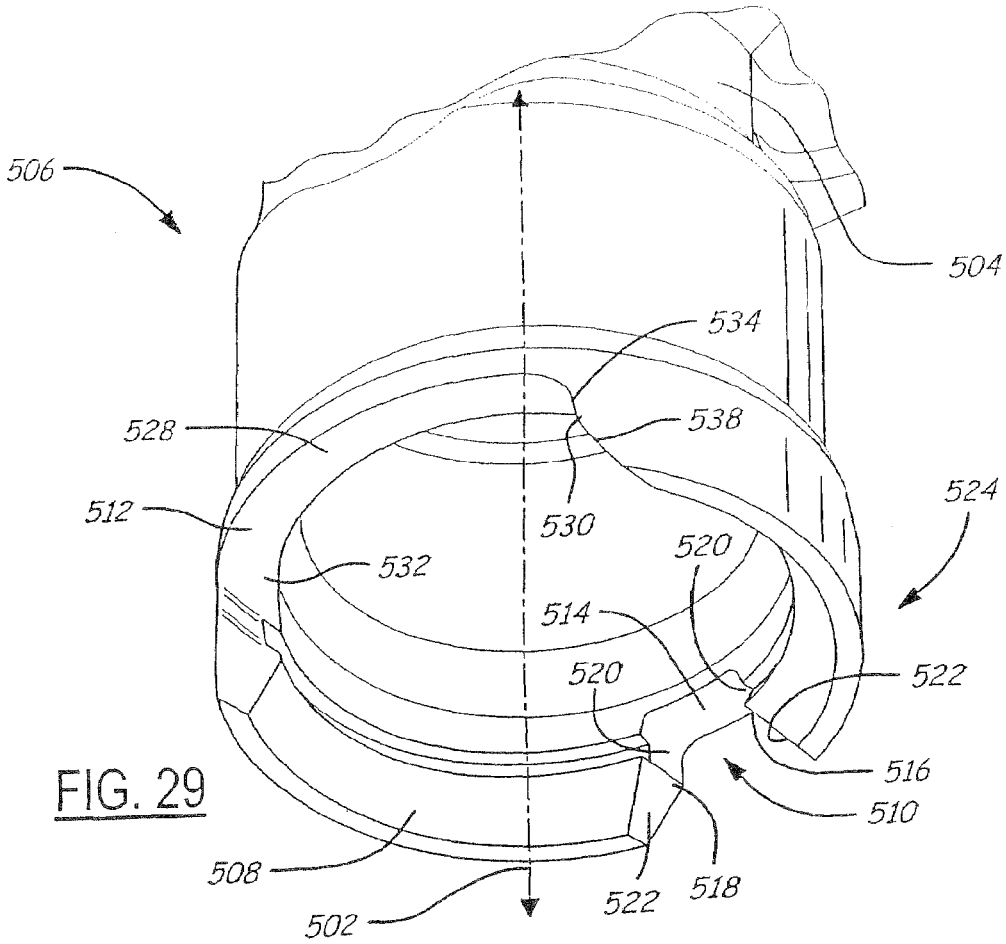
FIG. 29 is a perspective view of an exemplary embodiment of a fuel rail outlet cup shown in FIGS. 27 and 28.

With reference to FIG. 29, cup 500 defines a vertical axis 502 extending therethrough and has an inlet 504 at a first axial end 506 of cup 500 that is insertable into fuel rail outlet opening 24. Cup 500 is configured to receive the inlet portion 40 of a fuel injector 20. As shown in FIG. 32 and as discussed above, an O-ring 44 is sealably engaged with inlet portion 40 and is configured to be sealably engaged with an interior portion of cup 500. Cup 500 further includes a rim 508. Rim 508 includes a first slot 510 and a second slot 512 therein that are disposed on diametrically opposite sides of cup 500. In the illustrated exemplary embodiment, slot 510 is smaller in width than slot 512, and includes a base or bottom 514, as well as a pair of sides 516, 518. Sides 516, 518 each include a vertical portion 520 extending from base 514 in a vertical direction so as to be substantially parallel to axis 502, thereby defining a first slot width. Sides 516, 518 also include an angled portion 522 extending from vertical portion 520 at a predetermined angle to a second axial end 524 of cup 500. The angled portion and, more specifically, the predetermined angle, results in the creation of a second slot width that is greater than the first slot width.

Similarly, slot 512 also includes a base or bottom 528, as well as a pair of sides 530, 532. Sides 530, 532 each include a vertical portion 534 extending from base 528 in a vertical direction so as to be substantially parallel to axis 502, thereby defining a first slot width. Sides 530, 532 also include an angled portion 538 extending from vertical portion 534 at a predetermined angle to second axial end 524 of cup 500. The angled portion and, more specifically, the predetermined angle, results in the creation of a second slot width that is greater than the first slot width.

Figure 30:
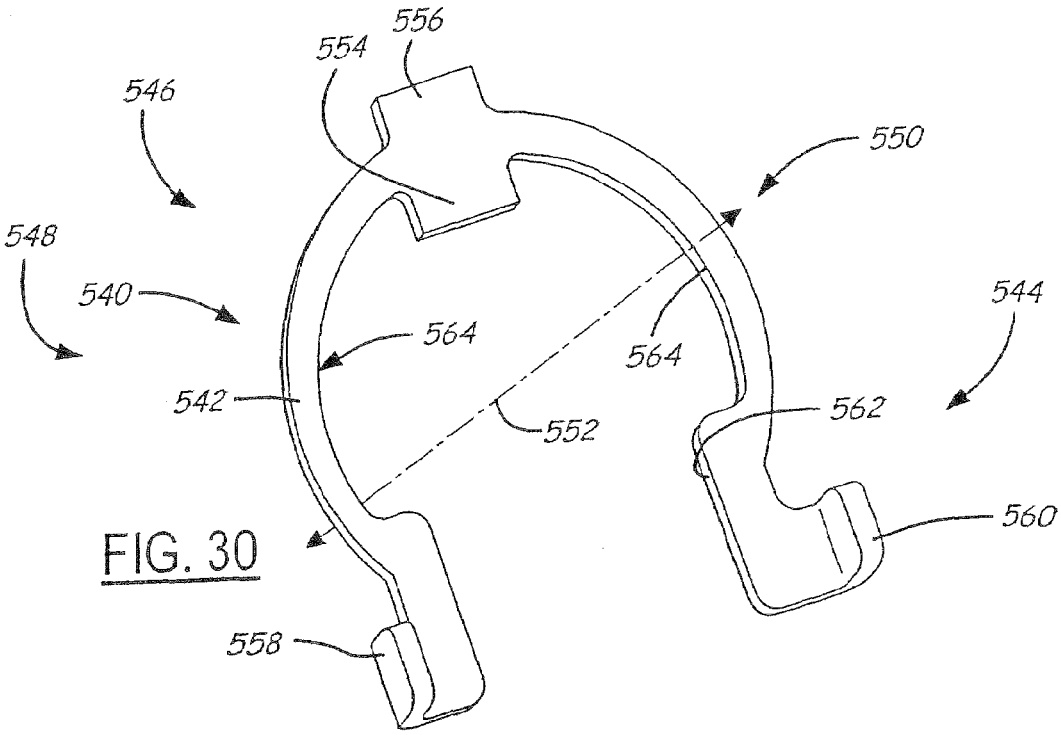
FIG. 30 is a perspective view of a fuel injector clip shown in FIGS. 27 and 28 utilized to retain a fuel injector in the fuel rail outlet cup shown in FIG. 29.

With reference to FIG. 30, fuel delivery system 7 further includes a fuel injector clip 540. Clip 540 has a base 542, which in turn includes an open end 544, a closed end 546 opposite open end 544, a first side 548, and a second side 550 opposite first side 548. Clip 540 also defines a vertical axis 552 extending through the center thereof Clip 540 further includes a pair of tabs 554, 556 protruding from either side of closed end 546 of clip base 542. As will be described in greater detail below, tab 554 is configured for engagement with a notch in the body of fuel injector 20 when clip 540 and injector 20 are coupled together. Tab 556 is sized and configured for insertion into first slot 510 in cup 500 when the combination of clip 540 and injector 20 are inserted into cup 500. Together, tabs 554, 556 provide orientation of injector 20 for off centerline injector spray applications.

With continued reference to FIG. 30, clip 540 still further includes a pair of ears 558, 560 extending upwards in an axial direction relative to axis 552 at either side of open end 544 so as to define a width of the opening at open end 544. As will be described in greater detail below, ears 558, 560 are spaced a predetermined distance apart so as to correspond to the first width of slot 512. In this arrangement, when clip 540 is assembled with injector 20 and the combination is inserted into cup 500, ears 558, 560 are located proximate to sides 530, 532 of slot 512. This arrangement provides for ears 558, 560 to be engaged with the outer surface of cup 500 (best shown in FIG. 27).

As illustrated in FIG. 30, base 542 of clip 500 includes an inner peripheral surface 562. Inner surface 562 includes a pair of arcuate recessed portions 564, one on either side 548, 550 of clip base 542. As shown in FIGS. 31*a* and 31*b*, recessed portions 564 are configured in size, shape and location on clip 540 to engage corresponding mating grooves 566 in the body of fuel injector 20. Grooves 566 are disposed about the outer circumference of the body of fuel injector 20 at diametrically opposite sides of injector 20 and have a slightly greater arcuate length than that of arcuate recessed portions 564. As also shown in FIGS. 31*a* and 31*b*, fuel injector 20 includes a notch 568 configured to receive and engage tab 554 of clip 540 when clip 540 is coupled with injector 20.

With reference to FIGS. 27, 28 and 31*b*-34, the coupling of clip 540 and injector 20 together (FIG. 31*b*), and the insertion of the clip/injector combination into cup 500 (FIGS. 27, 28 and 32-34) will be described. As shown in FIG. 31*b*, to assemble clip 540 and injector 20 together, arcuate portions 564 are radially aligned relative to axis 552 with grooves 566 of injector 20 (best shown in FIGS. 31*b* and 32). Open end 544 of clip 540 is then pushed and slid onto injector 20 in a radial direction. As clip 540 is pushed against the body of injector 20, injector 20 slides against inner peripheral surface 562, forcing the opening at open end 544 to deflect and widen to accommodate the size of injector 20. Once recessed arcuate portions 564 and grooves 566 meet and are aligned, the recessed arcuate portions 564 are seated in grooves 566. Additionally, once grooves 566 and arcuate portions 564 are engaged, notch 568 and tab 554 are likewise engaged such that tab 554 is seated within notch 568. This arrangement serves, at least in part, to prevent clip 540 from being rotated about injector 20. Once clip 540 and injector 20 are fully assembled, the opening of clip 540 reflects back to at least close to its original width. To remove injector 20 from clip 540, the opening of clip 540 is pulled open and the injector is removed.

With reference to FIGS. 33 and 34, once clip 540 and injector 20 are assembled together, the clip/injector combination is inserted into cup 500. To do so, tab 556 on clip 540 is aligned with slot 510 in cup 500, and the ears 558, 560 are aligned with slot 512 (not shown). As the combination is pressed into cup 500, tab 556 is inserted into slot 510, and ears 558, 560 are inserted into slot 512. When tab 556 reaches the bottom 514 of slot 510, the outer peripheral surface of tab 556 is in contact with sides 516, 518 so as to hold clip 540 and injector 20 in place. Similarly, and simultaneously, as the clip/injector combination is pressed into cup 500, a portion of the outer peripheral surface of each of ears 558, 560 contact and engage the outer surface of cup 500, thereby also serving to hold the combination in place. As discussed above, when the combination is inserted into cup 500, ears 558, 560 are located proximate to sides 532, 534 of slot 512. This arrangement, along with the arrangement of tab 554 within slot 510, serves to prevent the rotation of injector 20 while inserted into cup 500, and thereby limiting the axial and torsional movement of fuel injector 20. This arrangement further keeps clip 540 from opening by restraining clip 540 within cup 500. This arrangement still further provides a means of suspending the injector from the fuel rail in order to provide isolation from the cylinder head in an engine.

While embodiments of the present invention have been explained it will be readily apparent to those skilled in the art of the various modifications and changes which can be made from the present invention without departing from the spirit and scope of the accompanying claims.

The invention claimed is:

1. A fuel delivery system comprising:

a fuel rail having an outlet opening;

an outlet cup, said cup including an inlet that is insertable into said outlet opening and a flange wherein said flange includes at least one slot contained therein, said cup defining a vertical axis extending through the center of said inlet of said cup;

a fuel injector having a body with an inlet insertable within said cup;

a clip having a base, said base including an inner peripheral surface, at least a portion of which is configured for engagement with said fuel injector body when said clip is assembled with said fuel injector, said clip further including at least one arm extending front said base in an axial upward direction relative to said vertical axis, said arm configured for insertion in said slot of said flange of said cup, said arm including an axially downward extending finger configured for engagement with said flange of said cup, said clip operative to limit the axial and torsional movement of said fuel injector when said fuel injector is assembled with said clip and inserted in said cup.

2. A fuel delivery system in accordance with claim 1 wherein said clip has an open end and a closed end and includes an upward extending vertical member relative to said vertical axis proximate said closed end of said clip, said vertical member is configured to bend to facilitate the installation of said clip on said fuel injector.

3. A fuel delivery system in accordance with claim 1 wherein said at least one arm has an upside-down U-shape, and said finger extends downward from the center of the base of said "U".

4. A fuel delivery system in accordance with claim 1 wherein said finger includes a substantially vertical portion and a substantially angled portion relative to said vertical axis wherein said angled portion projects from said vertical portion in a radially outward direction in relation to said clip, said angled portion of said finger configured to engage said flange when said injector is inserted in said cup.

5. A fuel delivery system in accordance with claim 1, wherein said flange of said cup has a pair of slots disposed therein and said clip has a pair of axially extending arms, each of said arms including a finger, each one of said arms configured for insertion within a corresponding one of said slots, and each one of said fingers configured for engagement with said flange.

6. A fuel delivery system in accordance with claim 5 wherein said pair of slots are disposed at diametrically opposite sides of said flange and said pair of arms are disposed at diametrically opposite sides of said clip base so as to be in alignment with said slots when said fuel injector is assembled with said clip and said fuel injector is inserted into said cup.

7. A fuel delivery system in accordance with claim 1 wherein the arrangement of said clip and said cup when said injector is inserted in said cup is operative to limit the radial expansion of said clip.

8. A fuel injector clip for use in a fuel delivery system, comprising:

a base having an open end, a closed end, and inner peripheral surface at least a portion of which is configured for engagement with the body of a fuel injector when said clip is assembled with said fuel injector, said base defining a vertical axis extending therethrough perpendicular to a horizontal plane defined by said base; and a pair of arms extending from said base in an axially upward direction relative to said vertical axis, each of said arms including a finger extending axially downward from said arms and away from said vertical axis, said arms insertable within a pair of corresponding slots contained within a flange of a fuel outlet cup, said arms being configured to limit the radial expansion of said open end when inserted in said slots, and said fingers configured for engagement with said flange;

said clip operative to limit the axial and torsional movement of said fuel injector when said clip is assembled with said fuel injector and said fuel injector is inserted in said cup.

9. A fuel injector clip in accordance with claim 8 wherein said pair of arms are disposed at diametrically opposite sides of said clip base so as to be in alignment with said slots of said outlet cup when said fuel injector is assembled with said clip and said fuel injector is inserted into said cup.

10. A fuel injector clip in accordance with claim 8 wherein said portion of said inner peripheral surface configured for engagement with said fuel injector body is insertable into at least one groove in said body of said fuel injector.

11. A fuel injector clip in accordance with claim 8 wherein said base of said clip includes an upward extending vertical member relative to said vertical axis proximate said closed end, said vertical member configured to bend to facilitate the installation of said clip on said fuel injector.

12. A fuel injector clip in accordance with claim 8 wherein each of said pair of arms has an upside-down U-shape, and each of said fingers extends downward from the center of the base of said "U".

13. A fuel injector clip in accordance with claim 8 wherein said fingers include a substantially vertical portion and a substantially angled portion relative to said vertical axis wherein said angled portion projects from said vertical portion in a radially outward direction in relation to said body of said clip, said angled portion of said fingers configured to engage said flange when said clip is assembled with said fuel injector and said injector is inserted into said cup.

* * * * *